US006039419A

United States Patent [19]

Brown et al.

[11] Patent Number: 6,039,419

[45] Date of Patent: Mar. 21, 2000

[54] FOLDABLE READY-TO-USE ENTERTAINMENT STAND

[75] Inventors: Charles R. Brown; Marion O. Fogle; Thomas F. Salley, all of Orangeburg, S.C.

[73] Assignee: Decolam, Inc., Orangeburg, S.C.

[21] Appl. No.: 09/048,512

[22] Filed: Mar. 26, 1998

Related U.S. Application Data

[63] Continuation-in-part of application No. 08/754,887, Nov. 22, 1996, Pat. No. 5,769,514, and a continuation-in-part of application No. 08/885,296, Jun. 27, 1997, Pat. No. 5,882,098.

[51] Int. Cl.[7] ..... A47B 43/00

[52] U.S. Cl. ..... 312/262; 312/258; 16/387; 16/389; 16/390; 16/392

[58] Field of Search ..... 312/258, 259, 312/262, 140.2, 140.3, 140.1; 108/115, 193, 162, 179, 134; 211/149, 135; 16/387, 389, 390, 392

[56] References Cited

U.S. PATENT DOCUMENTS

| | | | |
|---|---|---|---|
| 795,844 | 8/1905 | March . | |
| 915,618 | 3/1909 | Mattison . | |
| 1,237,009 | 8/1917 | Yaw . | |
| 1,359,734 | 11/1920 | Parsons | 16/392 X |
| 1,568,167 | 1/1926 | Kunkle . | |
| 2,381,464 | 8/1945 | Rosenthal | 312/259 |
| 2,542,770 | 2/1951 | Hall . | |
| 2,648,870 | 8/1953 | Wilhelmi | 16/390 |
| 3,373,703 | 3/1968 | Barecki . | |
| 3,644,011 | 2/1972 | MacDonald | 312/258 |
| 3,854,828 | 12/1974 | Jones . | |
| 3,865,051 | 2/1975 | Johl et al. . | |
| 3,966,286 | 6/1976 | Groseclose | 312/262 X |
| 4,063,330 | 12/1977 | Triplette . | |
| 4,099,809 | 7/1978 | Leotta | 312/140.2 |
| 4,135,273 | 1/1979 | Holmes . | |
| 4,341,164 | 7/1982 | Johnson . | |
| 4,582,003 | 4/1986 | Valero . | |
| 4,715,296 | 12/1987 | Wilkinson . | |
| 4,731,029 | 3/1988 | Lerner et al. . | |
| 4,944,694 | 7/1990 | Dorn . | |
| 5,290,099 | 3/1994 | Lechman . | |
| 5,390,999 | 2/1995 | Fuller . | |
| 5,403,082 | 4/1995 | Kramer . | |
| 5,457,600 | 10/1995 | Campbell et al. . | |
| 5,487,525 | 1/1996 | Drabczyk et al. . | |
| 5,509,361 | 4/1996 | Chen . | |
| 5,518,310 | 5/1996 | Ellman et al. . | |
| 5,535,682 | 7/1996 | Aigeldinger . | |
| 5,664,854 | 9/1997 | Letch . | |

FOREIGN PATENT DOCUMENTS

| | | | |
|---|---|---|---|
| 136191 | 2/1950 | Australia | 312/258 |
| 1171771 | 1/1959 | France | 16/389 |
| 277942 | 9/1930 | Italy . | |
| 270985 | 5/1927 | United Kingdom . | |
| 1399532 | 7/1975 | United Kingdom . | |

*Primary Examiner*—Janet M. Wilkens
*Attorney, Agent, or Firm*—Cort Flint; Henry S. Jaudon

[57] ABSTRACT

A preassembled, foldable entertainment stand for a computer printer and the like is disclosed having a folded and erect configuration wherein a vertical back panel pivotally carries a plurality of vertical shelf panels. The shelf panels fold upwardly to a generally vertically position disposed near the front surface of the back panel while a top shelf panel folds upwardly to overlay the rear surface of the back panel. A pair of side panels are pivotally carried by the back panel. Panel hinges with displaced pivots secure the top panel and the side panels to the back panel so that the top panel lies flush against the back panel and the side panels fold generally flat over the shelf panels when the stand is folded for a compact folded configuration.

25 Claims, 5 Drawing Sheets

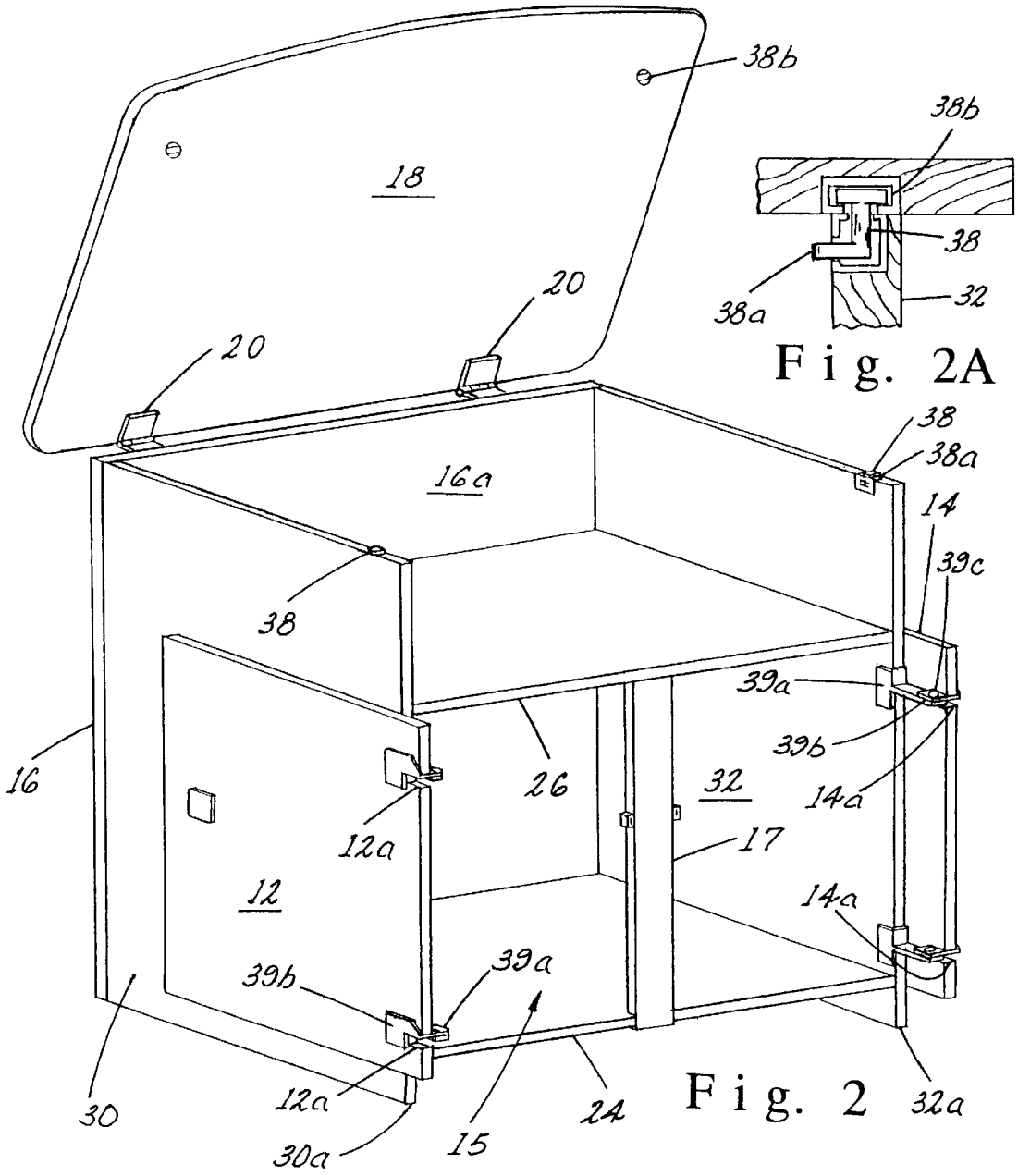
Fig. 2A
Fig. 2
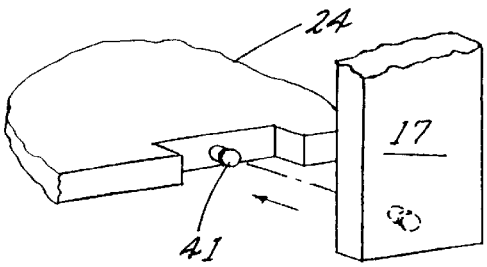
Fig. 2B
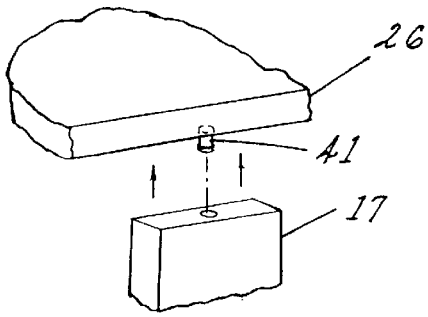
Fig. 2C

FOLDABLE READY-TO-USE ENTERTAINMENT STAND

This is a continuation-in-part of application Ser. No. 08/754,887 filed on Nov. 22, 1996, now U.S. Pat. No. 5,769,514, and application Ser. No. 08/885,296 filed on Jun. 27, 1997, now U.S. Pat. No. 5,882,098, both applications being incorporated by reference.

BACKGROUND OF THE INVENTION

This invention relates to a preassembled foldable, ready to use entertainment stand, and more particularly, to a stand for entertainment equipment and the like such as a television, monitor, or stereo equipment wherein the stand may be folded for shipment or storage and may be readily unfolded to a sturdy, erect configuration without need of assembly or other further effort.

Heretofore, desks and stands for computer and entertainment equipment have been provided which are shipped unassembled and must be assembled by the purchaser. The assembly has required much time and effort, and often produces frustration since the parts and their assembly are numerous. Such desks and stands are not readily useable when purchased due to the time and effort required for assembly, nor may they be readily taken apart or folded for storage.

U.S. Pat. No. 4,099,809 discloses a collapsible work station which comprises a rear support wall having a plurality of shelves of varying sizes. The shelves are hinged to the back support wall to assume various positions with respect to the support wall. Two side support walls fold over the shelves in a storing position. While this device provides a collapsible configuration for a work station there may be attached to partition walls and the like, the construction is not suitable for a general purpose stand wherein a closed top is desired. U.S. Pat. No. 4,579,401 discloses a collapsible cabinet, U.S. Pat. No. 2,764,462 discloses a portable collapsible bar, U.S. Pat. No. 3,346,317 discloses a foldable stand, U.S. Pat. No. 4,151,803 discloses a knock down floor display, and U.S. Pat. No. 835,902 discloses a knockdown wardrobe being of only general interest to the present invention.

Various entertainment tables include U.S. Pat. No. 5,535,682 which discloses a entertainment table having a top and portable legs. The legs fold up against the underneath of the top with the flexible strips gathering between the legs and top. U.S. Pat. No. 3,854,828 discloses a table with yet another arrangement of folding legs wherein a pivot includes first and second sections having threaded bores whereby the leg is locked in position by threading an end of the leg into both bores.

Computer desks are also known in various forms and combinations such as those shown in U.S. Pat. Nos. 5,403,082 and 5,290,099.

While the above arrangements are suitable for their various applications, the provision of a ready to use entertainment stand which may be easily set up and taken down while accommodating the various equipment used with television, computer, stereo equipment, and like equipment is a problem to which considerable attention need be given.

Accordingly, an object of the present invention is to provide a preassembled, foldable, ready to use entertainment stand for entertainment equipment and the like which may be readily folded for shipment or storage, and may be readily unfolded to a sturdy erect position for use.

Yet another important object of the present invention is to provide an entertainment stand having a folded configuration wherein various panels of the stand are folded about displaced pivots to provide a compact folded configuration.

Still another important object of the present invention is the provision of a preassembled, foldable entertainment stand having a top panel for supporting entertainment equipment, side panels, at least one interior shelf, and a pair of front doors, all of which may be folded into a compact, generally flat configuration for storage or transport, yet may be quickly unfolded and erected to an operational position.

SUMMARY OF THE INVENTION

The above objectives are accomplished according to the present invention by a preassembled, foldable ready to use entertainment stand having a folded and unfolded configuration comprising a back panel having a front and rear surface. A top panel is pivotally carried by the back panel by means of top panel displacement hinges having a displaced pivot axis which allows folding flat against the rear surface of the back panel. The top panel has a generally vertical position disposed near the rear surface of the back panel when the stand is in a folded configuration, and a generally horizontal position near the top of the back panel when the stand is in an erect configuration. At least one lower shelf panel is pivotally carried by the back panel having a generally vertical position near the front surface of the back panel when the stand is folded, and a generally horizontal position when the stand is erect. A first side panel is carried by the back panel by means of first side panel hinges having a displaced pivot axis displaced a distance from the front surface of the back panel. In this manner, the first side panel may fold about the shelf panel when in the folded configuration. A second side panel is pivotally carried by the back panel by means of second side panel hinges having a displaced pivot axis so that the second side panel also folds inwardly about the shelf panels.

Preferably, a utility shelf panel is also carried by the back panel between the top panel and a bottom shelf panel. The utility shelf panel also has a vertical position near the front surface of the back panel when the stand is folded with the first and second side panels folded over the shelf panel.

Advantageously, the side panel displacement hinges are vertically spaced so that the opposing side edges of the shelf panels fit between the panel hinges when the shelf panels are in the vertical positions and the stand is folded. First and second front doors are carried by said respective first and second side panels enclosing an interior space of the stand. First and second flush hinge means are provided for pivotally carrying said first and second front doors so that said front doors open and pivot rearwardly to a generally flush position with respect to said first and second side panels when in said folded configuration. Advantageously, each flush hinge means includes a first hinge part carried by each of the first and second side panels, a second hinge part carried by each front door, a slot formed in each front door, and an intermediate hinge part received in the slot interconnecting said first and second hinge part. The first and second front doors having upper edges terminate generally below a support surface of the utility shelf whereby the utility shelf is open with the doors closed.

A removable vertical post is carried between the bottom and utility shelf when in said unfolded configuration, and connector means is provided for removably interconnecting said vertical post and the shelves so that said post may be removed and the shelves moved to the folded configuration.

A first and second latch are carried between the first and second side panels and the top panel for latching the first and second side panels and top panel together when erected. The first and second side panels extend in a generally perpendicularly way from the front surface of the back panel. The first and second latches include latch finger elements carried by an upper edge of the first and second side panels, and cooperating latch elements carried by the top panel for latching with the first latch elements.

Advantageously, a compact configuration is provided by the top panel having a width generally equal to or greater than the width of the back panel, and the shelf panels having a width which is less than the width of the back panel. The side panels are spaced a distance less than or equal to the width of the back panel when the stand is erect. The thickness of the side panels plus the width of the shelf panels is less than or equal to the width of the back panel.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2 is a perspective view of the entertainment stand constructed according to the present invention having a folded and unfolded, erect configuration wherein the stand is in a partially folded condition;

FIGS. 2A, 2B, and 2C show interlocking features of several components of the stand of FIG. 2;

DESCRIPTION OF A PREFERRED EMBODIMENT

Figure 7:
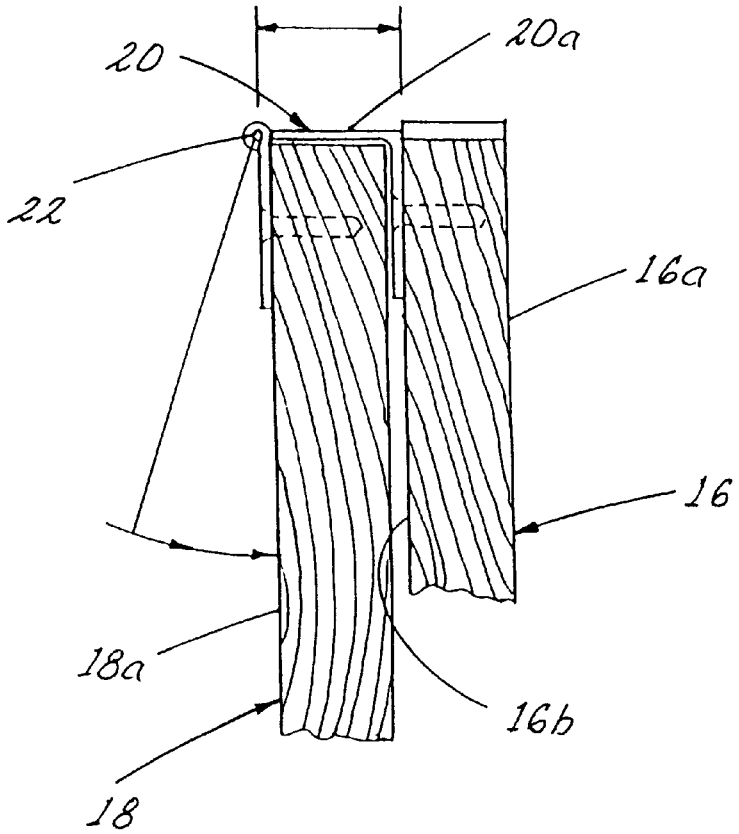
FIG. 7 is a side view of the entertainment stand of the present invention in a folded configuration showing the top displacement pivot hinges.

Referring now in more detail to the drawings, a preassembled, foldable entertainment stand for a television and the like, designated generally as A, is illustrated. For example, the preassembled, foldable entertainment stand may be utilized to support a television 10, or a stereo or similar equipment. Entertainment stand A includes a back panel 16 having a front surface 16*a* and a back surface 16*b*. A top panel 18 is pivotally carried by back panel 16 by at least one top panel hinge 20 having a displaced pivot 22 which is displaced a distance from the rear surface of back panel 16 (FIG. 7). Preferably there are two such hinges 20 carried in a spaced apart manner by back panel 16. There is at least one lower shelf panel 24, and preferably an intermediate shelf panel 26 pivotally carried by back wall 16. Shelf panels 24 and 26 are carried by conventional panel hinges 28. Preferably, a utility space 29 is provided atop shelf 26 for auxiliary entertainment equipment such as a VCR. A first front door 12 and a second front door 14 enclose an interior space 15 between shelves 24 and 26, while leaving auxiliary space 29 open. A center post 17 braces between the two shelves.

Figure 6:
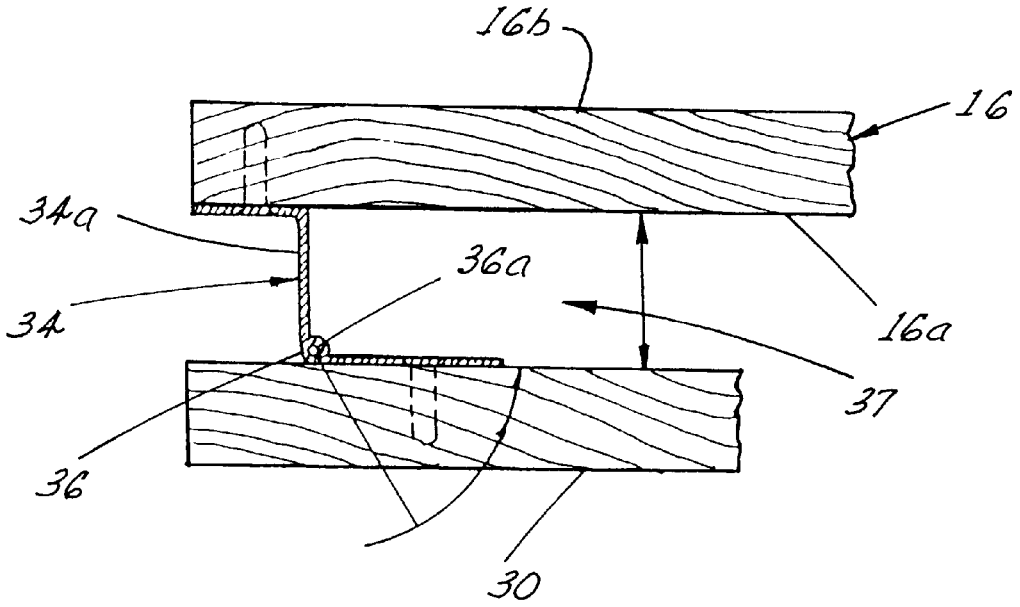
FIG. 6 is a top plan view of the entertainment stand of the present invention showing the side panel displaced pivot hinge in a folded configuration.

A first side panel 30 and a second side panel 32 are pivotally carried by back panel 16. There is at least a first side panel hinge 34 having a displaced pivot axis 36 (FIG. 6) carried by the back panel which pivotally attaches each side panel to the back. Preferably, there are two such side panel hinges 34 which are vertically spaced on each side of the back panel to secure the side panels. Each hinge has a displaced pivot axis 36 which is displaced a distance from front surface 16*a* of the back panel so that the side panels may fold about the shelf panels when the stand is in a folded configuration to define a storage space 37 for shelves 26 and 24.

It will be noted that pivot 36*a* of hinge 34*a* is displaced a greater distance from back panel 16 than in pivot 36*b* of hinge 34*b*. This allows storage space 37 to be sufficiently deep to allow for second side panel 32 and second front door 14 to be folded inside first side panel 30.

Front doors 12 and 14 are hinged to side panels 30 and 32 by means of flush mount hinges 39 having a first hinge part 39*a* mounted to an associated side panel, a second hinge part 39*b* mounted to a respective door, and a displaced pivot 39*c*. Second hinge part 39*b* connects to the pivot by means of a slot 12*a*, 14*a* found in the respective front doors 12 and 14. The flush mount hinges allow the doors to fold back flush against its associated side panel.

Figure 1:
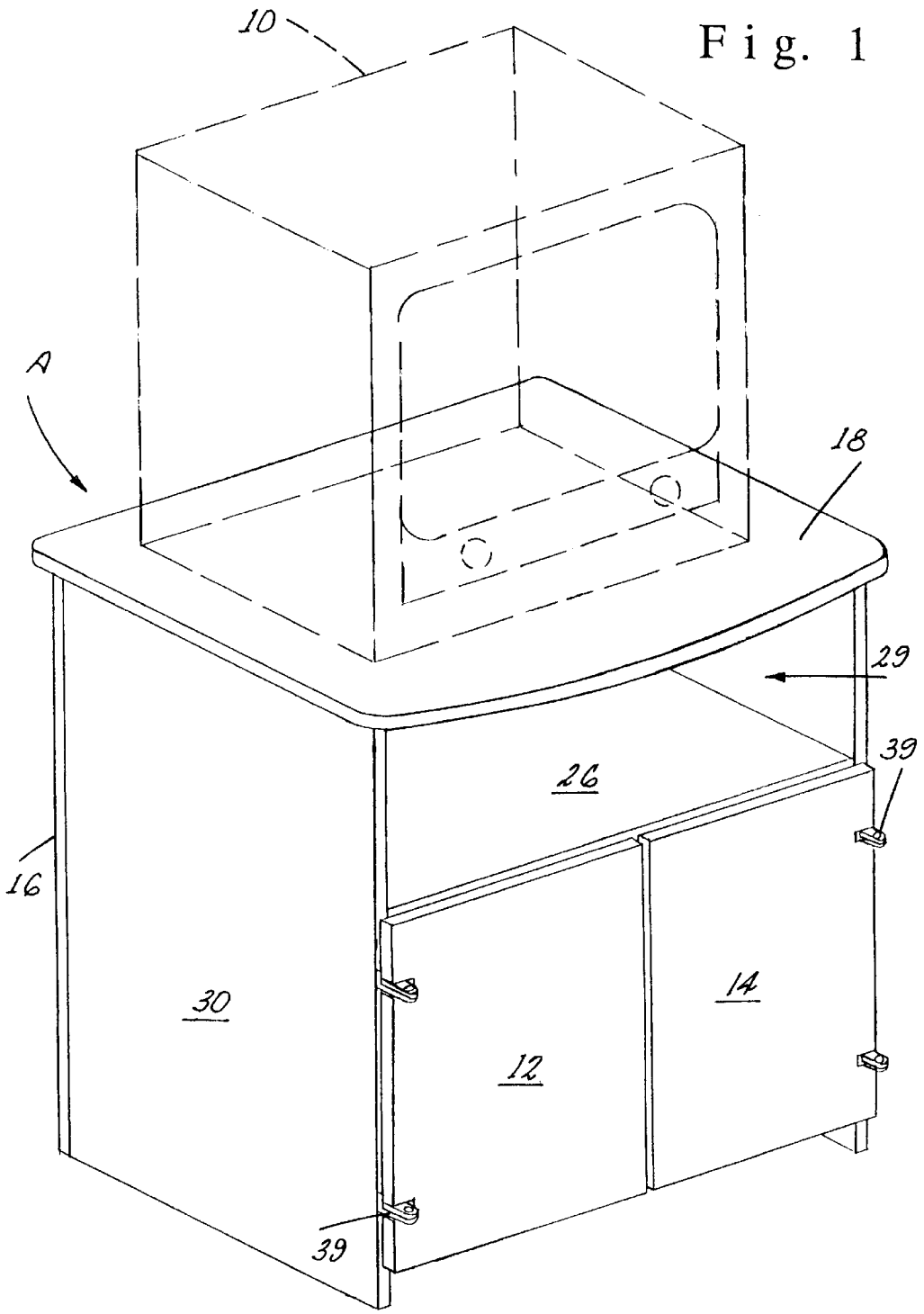
FIG. 1 is a perspective view illustrating a preassembled, foldable entertainment stand for use with associated entertainment equipment.
Figure 4:
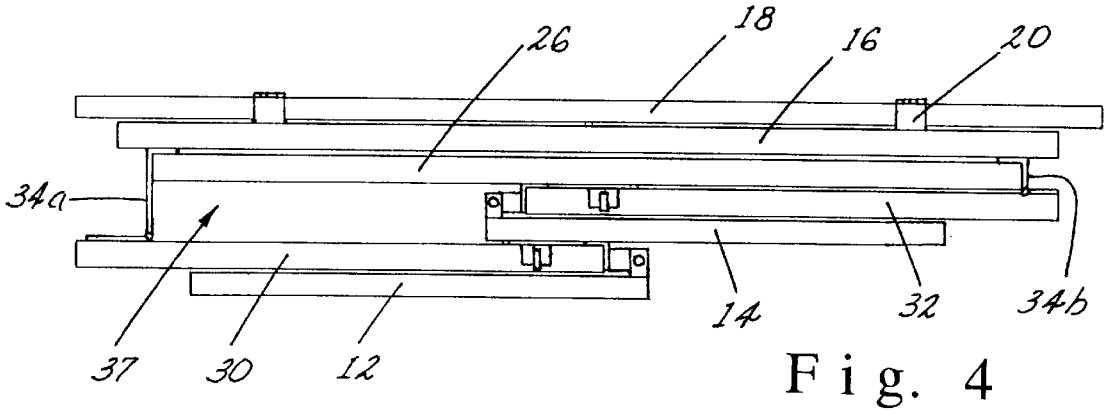
FIG. 4 is a top plan view of a preassembled, foldable entertainment stand of the invention in a folded configuration.
Figure 5:
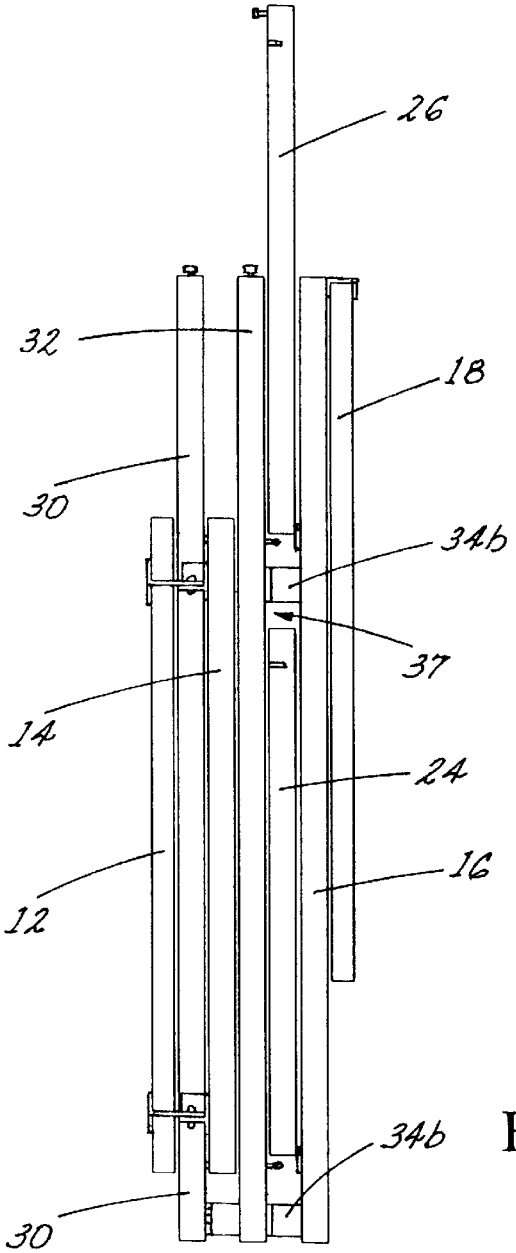
FIG. 5 is a side elevation of a preassembled, foldable entertainment stand according to the invention shown in a folded configuration.

As noted above, entertainment stand A has a folded configuration (FIGS. 4, 5) and an unfolded, erect configuration (FIG. 1). The folded configuration is for storage and the unfolded configuration is for use. Top panel 18 has a generally vertical position disposed near rear surface 16*b* of back panel 16 when the stand is in the folded configuration, and top panel 18 has a generally horizontal position overlying the top edges of side panels 30, 32 and back panel 16 in the unfolded, erect configuration. Lower shelf panels 24, 26 have a generally vertical position near the front surface of back panel 16 when the stand is in the folded configuration, and a generally horizontal, cantilevered position when the stand is unfolded and erect. Side panel 32 is folded about the folded shelf panels with door 14 lying flush against the side panel when the stand is in the folded configuration. Side panel 30 is folded over side panel 32 and door 14, with its associated door 12 lying flush. As can best be seen in top plan view FIG. 4 and side elevation view FIG. 5, a compact configuration is provided for the entertainment stand by the construction of the present invention for storage, transportation, and shipping.

A first latch 38 is carried between side panels 30 and 32 and top panel 18 for latching the side panels and top panel together in the unfolded configuration wherein the side panels extends generally perpendicularly away from the back panel. Latch 38 may be any suitable latch such as a cam lock latch having a first latch element 38*a* in the form of a projection carried by an upper edge of the side panels. The projecting first latch elements are received in a cooperating receptacle latch elements 38*b* carried recessed underneath top panel 18 (FIGS. 2 and 2A). The latches secure the stand in a sturdy erect configuration. Conventional snap connectors 41 secure post 17 and shelves 24, 26.

Figure 3:
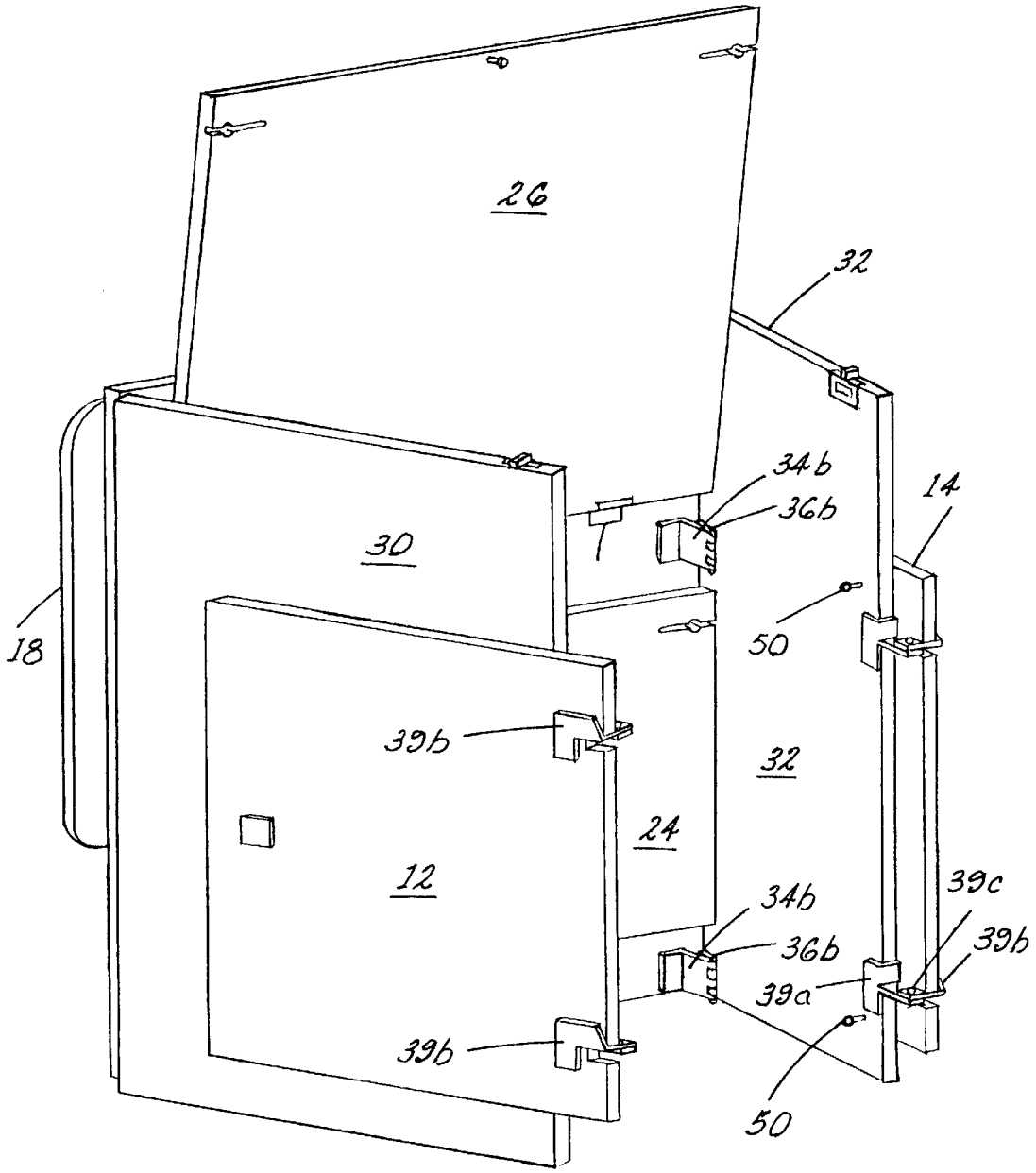
FIG. 3 is a perspective view of the entertainment stand of the present invention partially folded.

As can best be seen in FIG. 3, in order to facilitate folding to a compact configuration, hinges 34 (34*a*, 34*b*) are located outside the edges of shelf panels 24, 26 in order to facilitate folding of the shelf panels flush with the back panel. Top panel 18 has a width generally equal to greater than the width of back panel 16 and shelf panels 24 and 26 have a width which is less than the width of the back panel as can best be seen in FIG. 4. The outside exterior of side panels are spaced a distance apart less than or equal to the width of back panel 16 when the stand is erect in its unfolded configuration. The thickness of side panels 32 and 30, plus the width of shelf panels 24 and 26 is generally equal to the width of the back panel 16. Side panels 32 and 24 terminate in floor engaging support, 30*a* and 32*a*, by which top panel 18 is supported above the floor in the unfolded configuration.

To support shelf panels 24 and 26 in the unfolded configuration, shelf supports 50 are carried by side panels 30 and 32, which may be conventional screws or shelf supports.

While a preferred embodiment of the invention has been described using specific terms, such description is for illustrative purposes only, and it is to be understood that changes and variations may be made without departing from the spirit or scope of the following claims.

What is claimed is:

1. A preassembled, foldable ready to use entertainment stand having a folded and unfolded configuration comprising:

a top panel having a support surface for supporting entertainment equipment;

a back panel pivotally connected to said top panel having a front surface and a rear surface;

at least one top panel hinge having a displaced pivot axis displaced a distance from said rear surface of said back panel;

said top panel having a generally vertical position disposed near said rear surface of said back panel when said stand is in said folded configuration, and said top panel having a generally horizontal position near a top of said back panel when said stand is in said unfolded configuration;

at least a bottom shelf panel pivotally carried by said back panel, and said shelf panel having a generally vertical position near the front surface of said back panel when said stand is in said folded configuration and a generally horizontal position when said stand is in said unfolded configuration;

an interior space defined in part between said top panel and said bottom shelf panel when said stand is in said unfolded configuration;

a first side panel carried by said back panel;

at least a first side panel hinge pivotally connecting said first side panel to said back panel, said side panel hinge having a displaced pivot axis displaced a distance from the front surface of said back panel so that said first side panel may fold about said bottom shelf panel when said stand is in said folded configuration;

a second side panel pivotally carried by said back panel;

at least a second side panel hinge pivotally connecting said second side panel to said back panel;

said second side panel hinge having a displaced pivot axis displaced a distance from the front surface of said back panel so that said second side panel folds inwardly about said bottom shelf panel when said stand is in said folded configuration;

first and second front doors enclosing said interior space carried by said respective first and second side panels; and first and second door hinges for pivotally carrying said first and second front doors so that said front doors open and pivot rearwardly to a generally flush position with respect to said first and second side panels when said stand is in said folded configuration;

so that a compact folded, ready-to-use entertainment stand is provided which may be readily erected for use.

2. The stand of claim 1 wherein each said door hinge includes a first hinge part carried by each said first and second side panels, a second hinge part carried by each said front door and pivotally connected with said first hinge part, a slot formed in an outer edge of each said front door, and one of said first and second hinge parts being received through a respective said slot of each door.

3. The stand of claim 1 wherein said first and second side panels are folded inwardly in a partially overlapping manner when said stand is in said folded configuration.

4. The stand of claim 1 including:

a utility shelf panel carried by said back panel between said top panel and said bottom shelf panel; and said utility shelf panel having a vertical position near the front surface of said back panel when said stand is in said folded configuration with said first and second side panels folded over said shelf panels.

5. The stand of claim 4 including a removable vertical post carried between said bottom and utility shelf panels when said stand is in said unfolded configuration, and a removable interconnector interconnecting said vertical post and said shelf panels so that said post may be removed and said shelf panels folded when said stand is in said folded configuration.

6. The stand of claim 1 including a pair of spaced top panel hinges having said displaced pivots for pivotally attaching said top panel to said back panel.

7. The stand of claim 1 including a pair of vertically spaced first side panel hinges having said displaced pivots for pivotally attaching said first side panel to said back panel.

8. The stand of claim 7 including a pair of vertically spaced second side panel hinges carried by said front surface of said back panel having said displaced pivots for pivotally attaching said second side panel to said back panel.

9. The stand of claim 8 wherein said shelf panel includes front and rear opposing side edges which are received between said vertically spaced side panel hinges when said shelf panel is in said vertical position and said stand is in said folded configuration.

10. The stand of claim 8 wherein said pivot axis of said first side panel hinges is displaced a greater distance than the pivot axis of said second side panel hinges so that said first side panel and door are folded at least partially over said second side panel and door.

11. The stand of claim 1 wherein each said door hinge includes a first hinge part carried by each said first and second side panels, a second hinge part carried by each said front doors, an edge slot formed in each said front doors, and one of said hinge parts being received through a respective said slot of each door.

12. The stand of claim 1 including a first latch carried between said first side panel and said top panel for latching said first side and top panels together when said stand is in said unfolded configuration wherein said first side panel extends generally perpendicularly away from the front surface of said back panel; and a second latch for latching said top panel and said second side panel together when said stand is in said unfolded configuration wherein said second side panel extends in a generally perpendicular manner from the front surface of said back panel.

13. The stand of claim 12 wherein said first and second latches include first latch elements carried by an upper edge of said first and second side panels, and second cooperating latch elements carried by said top panel for latching with said first latch elements.

14. The stand of claim 1 wherein said top panel has a width generally equal to or greater than the width of said back panel; and said shelf panels have a width which is less that the width of said back panel.

15. The stand of claim 14 wherein said side panels are spaced a distance less than or equal to the width of said back panel when said stand is in said unfolded configuration.

16. The stand of claim 15 wherein the thickness of said side panels plus the width of said shelf panels is less than or equal to the width of said back panel.

17. A foldable ready to use entertainment stand having a folded and an unfolded configuration comprising:

a back panel having a front and a rear surface;

a top pivotally attached to said back panel having a support surface for supporting entertainment equipment;

said top having a generally vertical position disposed near said rear surface of said back panel when said stand is in said folded configuration, and said top panel having a generally horizontal position near a top of said back panel when said stand is in said unfolded configuration;

first and second spaced side panels pivotally carried by said back panel, said first and second side panels terminating in floor engaging supports for supporting said top above a floor;

a utility shelf panel spaced from and underneath said top defining a utility space for associated entertainment equipment;

said utility shelf panel pivotally attached to said back panel;

said utility shelf panel having a vertical position near the front surface of said back panel when said stand is in said folded configuration with said first and second side panels folded over at least a portion of said utility shelf panel when said stand is in said folded configuration;

a bottom shelf panel pivotally carried by said back panel below said utility shelf panel, said bottom shelf panel having a generally vertical position near the front surface of said back panel when said stand is in said folded configuration and a generally horizontal position when said stand is in said unfolded configuration;

said first side panel generally overlying at least a part of said back panel when said stand is in said folded position and generally extending away from said back panel in an extended position to engage the floor and to support said top and the equipment thereon when said stand is in said unfolded configuration;

said second side panel generally overlying at least a part of said first side panel when said stand is in said folded position and generally extending away from said back panel in an extended position to engage the floor and to support said top and the equipment thereon when said stand is in said unfolded configuration;

a plurality of displacement hinges attaching said first and second side panels to said back panel, each of said displacement hinges having a first part attached to said back panel, a second part attached to said side panels, and a displaced pivot so that said first and second side panels are displaced from said back panel when said stand is in said folded configuration to define a storage space between said back panel and said first and second side panels; and said utility shelf panel and said bottom shelf panel being folded and disposed in said storage space when said stand is in said folded configuration;

whereby a compact, folded configuration is provided for convenient storage and/or transportation.

18. The stand of claim 17 wherein said displacement hinges displace said first side panel a greater distance from said back panel than said second side panel is displaced from said back panel.

19. The stand of claim 17 including first and second front doors carried by said respective first and second side panels enclosing an interior space of said stand; and first and second flush hinge means for pivotally carrying said first and second front doors so that said front doors open and pivot rearwardly to a generally flush position with respect to said first and second side panels when said stand is in said folded configuration.

20. The stand of claim 19 wherein each said flush hinge means includes a first hinge part carried by each said first and second side panels, a second hinge part carried by each said front door, an edge slot formed in each said front door, and an intermediate hinge part received in a respective said slot of each door interconnecting said first and second hinge part.

21. The stand of claim 17 including a removable vertical post carried between said bottom and utility shelf panels when said stand is in said unfolded configuration, and connector means removably interconnecting said vertical post and said bottom and utility shelf panels so that said post may be removed.

22. The stand of claim 17 including first and second front doors enclosing an interior space, said first front door being carried by said first side panel and said second front door being carried by said second side panel; and said first and second front doors having upper edges terminating generally below a support surface of said utility shelf panel whereby said utility space is open with said doors closed.

23. A foldable, ready-to-use entertainment stand having a folded and unfolded configuration comprising:

a back panel;

a top pivotally attached to said back panel;

first and second side panels pivotally attached to said back panel for supporting said top;

a horizontal shelf spaced below said top, and hinges secured with said horizontal shelf and said back panel pivotally attaching said horizontal shelf to said back panel;

first and second front doors carried by said first and second side panels, respectively, for enclosing an interior space of said entertainment stand;

first and second displacement hinges secured to said back panel and said first and second side panels pivotally attaching said first and second side panels to said back panel in spaced apart manner defining a storage space when said first and second side panels are folded about said first and second displacement hinges when said stand is in said folded configuration;

said horizontal shelf being disposed in said storage space when folded to a generally flush configuration with said back panel when said stand is in said folded configuration;

rearwardly pivoting top hinge means attaching said top to said back panel so that said top panel may be pivoted rearwardly to a generally flush position with said back panel when said stand is in said folded configuration; and flush door hinge means pivotally attaching said first and second front doors to said first and second side panels so that said first and second front doors may be folded generally flush with said first and second side panels, respectively, when said stand is in said folded configuration.

24. The stand of claim 23 wherein said first and second front doors having upper edges terminating generally below a support surface of said shelf to define a utility space which is open from the front of the stand with said doors closed.

25. The stand of claim 23 wherein said first and second side panels are folded at least partially into overlaying positions.

* * * * *